US011213129B2

(12) United States Patent
Davidson

(10) Patent No.: US 11,213,129 B2
(45) Date of Patent: Jan. 4, 2022

(54) WOBBLE STOOL AND BASE

(71) Applicant: KLD IP Holdings, LLC, Neosho, MO (US)

(72) Inventor: Richard D. Davidson, Neosho, MO (US)

(73) Assignee: KLD IP Holdings, LLC, Neosho, MO (US)

( * ) Notice: Subject to any disclaimer, the term of this patent is extended or adjusted under 35 U.S.C. 154(b) by 0 days.

(21) Appl. No.: 17/144,009

(22) Filed: Jan. 7, 2021

(65) Prior Publication Data

US 2021/0127834 A1 May 6, 2021

Related U.S. Application Data

(63) Continuation-in-part of application No. 16/038,286, filed on Jul. 18, 2018, now abandoned.

(51) Int. Cl.

| | |
|---|---|
| ***A47C 3/029*** | (2006.01) |
| ***A47C 7/00*** | (2006.01) |
| ***A47B 91/00*** | (2006.01) |

(52) U.S. Cl.

CPC ..... *A47C 3/029* (2013.01); *A47B 91/00* (2013.01); *A47C 7/002* (2013.01)

(58) Field of Classification Search

CPC ..... A47C 3/029; A47C 7/002; A47B 91/00
See application file for complete search history.

(56) References Cited

U.S. PATENT DOCUMENTS

| | | | |
|---|---|---|---|
| 2,049,539 | A | 8/1936 | Greenwood |
| 2,988,358 | A | 6/1961 | Mills |
| 4,084,273 | A | 4/1978 | Haynes |
| 6,116,690 | A | 9/2000 | Larson |
| 7,219,956 | B2 | 5/2007 | Zhang |
| 8,221,246 | B2 | 7/2012 | Lee et al. |
| 8,500,075 | B2 | 8/2013 | Frost et al. |
| 9,010,867 | B2 | 4/2015 | Martin et al. |
| D801,714 | S | 11/2017 | Elmaleh |
| D806,414 | S | 1/2018 | Elmaleh |
| 2003/0164633 | A1 | 9/2003 | Jakus et al. |
| 2008/0093896 | A1 | 4/2008 | Zhang |

OTHER PUBLICATIONS

Bumgardner, Wendy, "Wobble Stool for Active Sitting Review", printed from https://www.verywellfit.com/wobble-stoo-for-active-sitting-review-3435453 on Jun. 5, 2018.

*Primary Examiner* — Anthony D Barfield

(74) *Attorney, Agent, or Firm* — Martin & Associates, LLC; Derek P. Martin

(57) ABSTRACT

A wobble base provides a curved floor-contacting surface with one or more alignment posts that align the wobble base to the bottom of a seating platform and one or more holes separate from the alignment posts through which one or more fasteners may be placed to attach the wobble base to the seating platform, thereby providing a wobble stool. The wobble base can be configured to convert an existing stool into a wobble stool by replacing one or more floor-contacting members with the wobble base. In a second embodiment, a seating platform, such as a stool, is provided with both traditional floor-contacting members, such as feet or casters, and with a wobble base that allows the traditional floor-contacting members to be removed and replaced with the wobble base, and allows the wobble base to be removed and replaced with the traditional floor-contacting members.

21 Claims, 11 Drawing Sheets

WOBBLE STOOL AND BASE

BACKGROUND

Technical Field

This disclosure generally relates to seating, and more specifically relates to wobble stools.

Background Art

Mankind has invented various types of seating throughout the centuries. Schools have typically used desks for students. More recent advancements have realized the benefit of alternative forms of seating, especially in a school environment. Some students, especially special-needs students, benefit from what has become known as "active seating." Active seating is seating that allows the seated person to move somewhat while seated.

Stools have long been used in a variety of settings. Most known stools have multiple legs or casters that all contact the floor to provide a stable base that maintains the seat parallel to the floor or ground. Wobble stools have been recently developed as one form of active seating that allows a person to move somewhat while seated. Known wobble stools have a seat attached to a curved base, allowing the person who is seated to tilt forward, backward, or sideways while seated.

Replacing existing desks or stools with wobble stools is an expensive proposition, especially for public schools that have limited funds. This makes wobble stools unavailable in many settings where they would be very beneficial.

BRIEF SUMMARY

A wobble base provides a curved floor-contacting surface with one or more alignment posts that align the wobble base to the bottom of a seating platform and one or more holes separate from the alignment posts through which one or more fasteners may be placed to attach the wobble base to the seating platform, thereby providing a wobble stool. The wobble base can be configured to convert an existing stool into a wobble stool by replacing one or more floor-contacting members with the wobble base. In a second embodiment, a seating platform, such as a stool, is provided with both traditional floor-contacting members, such as feet or casters, and with a wobble base that allows the traditional floor-contacting members to be removed and replaced with the wobble base, and allows the wobble base to be removed and replaced with the traditional floor-contacting members. This allows the seating platform to be dynamically reconfigured as needed.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

A wobble base provides a curved floor-contacting surface with one or more alignment posts that align the wobble base to the bottom of a seating platform and one or more holes separate from the alignment posts through which one or more fasteners may be placed to attach the wobble base to the seating platform, thereby providing a wobble stool. The wobble base can be configured to convert an existing stool into a wobble stool by replacing one or more floor-contacting members with the wobble base. In a second embodiment, a seating platform, such as a stool, is provided with both traditional floor-contacting members, such as feet or casters, and with a wobble base that allows the traditional floor-contacting members to be removed and replaced with the wobble base, and allows the wobble base to be removed and replaced with the traditional floor-contacting members. This allows the seating platform to be dynamically reconfigured as needed.

Figure 1:
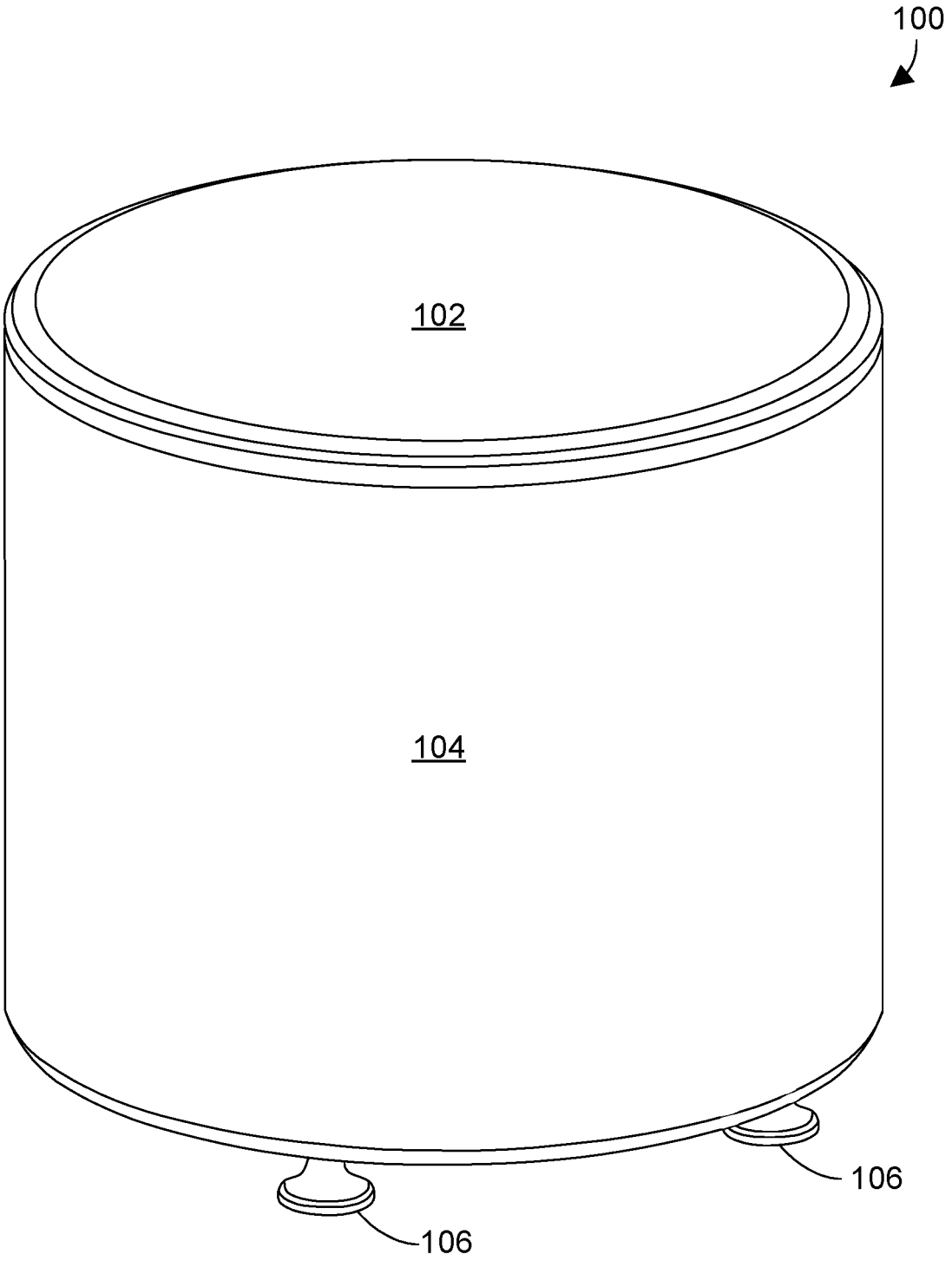
FIG. 1 is an upper perspective view of a stool that has removable legs.
Figure 2:
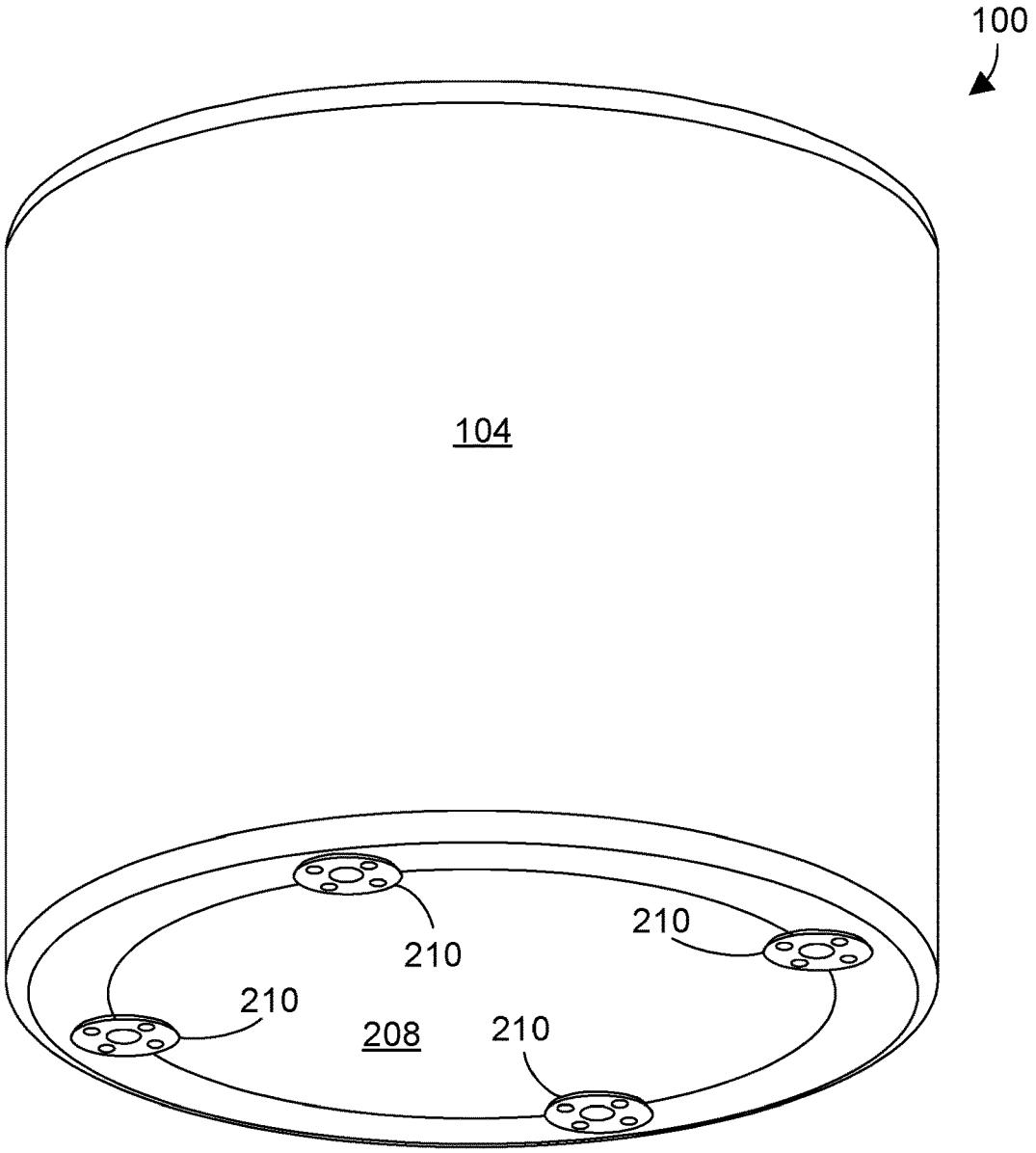
FIG. 2 is a lower perspective view of the stool in FIG. 1 showing receptacles for receiving the legs.
Figure 3:
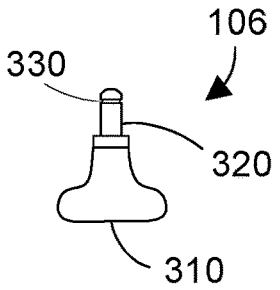
FIG. 3 is a front view of a leg shown in FIG. 1.

FIG. 1 is an upper perspective view of a stool 100 that includes a seat 102 and a body portion 104, and that is attached to four legs 106, two of which are shown in FIG. 1. Stool 100 with legs 106 is one suitable example of a seating platform. FIG. 2 is a lower perspective view of the stool 100 in FIG. 1 showing four receptacles 210 on the bottom 208 that each receives one of the legs 106 such that the legs 106 are removable. In the specific configuration shown in FIG. 2, each receptacle 210 is attached to the bottom 208 using four screws, and each faces substantially down. One suitable configuration for the leg 106 is shown in FIG. 3, and includes a substantially flat floor-contacting surface 310 and a post 320 that includes an annular slot 330. The annular slot 330 can include a snap ring that is compressed slightly as the leg 106 is pushed into the receptacle 210 to reduce its diameter, then springs back to its normal size within the receptacle to removably lock the leg 106 in place within the receptacle. In the alternative, the receptacle 210 could include a snap ring or other mechanism that engages the annular slot 330 to retain the leg 106 in place. In one specific configuration, the leg 106 can be removed by pulling the leg out of the receptacle 210. In a different configuration, the leg 106 can be removed after pressing a button to release the leg 106 from the receptacle 210. The receptacles 210 thus provide a way to removably couple the legs 106 to the stool 100.

Figure 4:
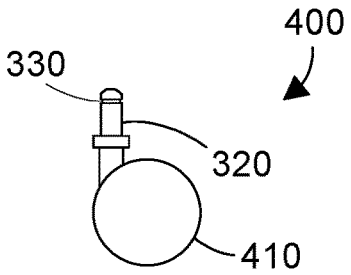
FIG. 4 is a front view of a roller or caster.

The legs 106 are generally referred to herein as "floor-contacting members", meaning members that removably attach to the stool and contact the floor or ground when properly installed on the stool. Besides legs, another type of known floor-contacting member is rollers or casters. An example of a suitable roller or caster is shown at 400 in FIG. 4., which we refer to as caster 400 herein. Note the caster 400 has a post 320 and annular slot 330 that are preferably the same as the leg shown in FIG. 3. This allows either the leg 106 or the caster 400 to be used as floor-contacting members for the stool 100. Thus, if the stool is to be used in a setting where the stool does not need to be moved about, the feet 106 could be installed in the four receptacles 210. If the stool is to be used in a setting where the stool needs to be moved about, the casters 400 could be installed in the four receptacles 210, thereby allowing the stool to be rolled on the casters. Caster 400 could be a rigid caster or a swivel casters. Most know seating platforms that have casters use swivel casters that allow a seated person to move in any desired direction. Another example of floor-contacting members are plastic buttons that are nailed or screwed to the bottom of a seating platform, and which contact the floor and allow sliding the stool along the floor. When such plastic buttons are used as floor-contacting members, these buttons are not installed into receptacles that can be used to hold a wobble base in place. When plastic buttons are used as floor-contacting members, one or more receptacles for the wobble base are preferably provided in addition to the plastic buttons. The plastic buttons could be removed before installing the wobble base, or the wobble base could be installed with the plastic buttons in place.

Figure 5:
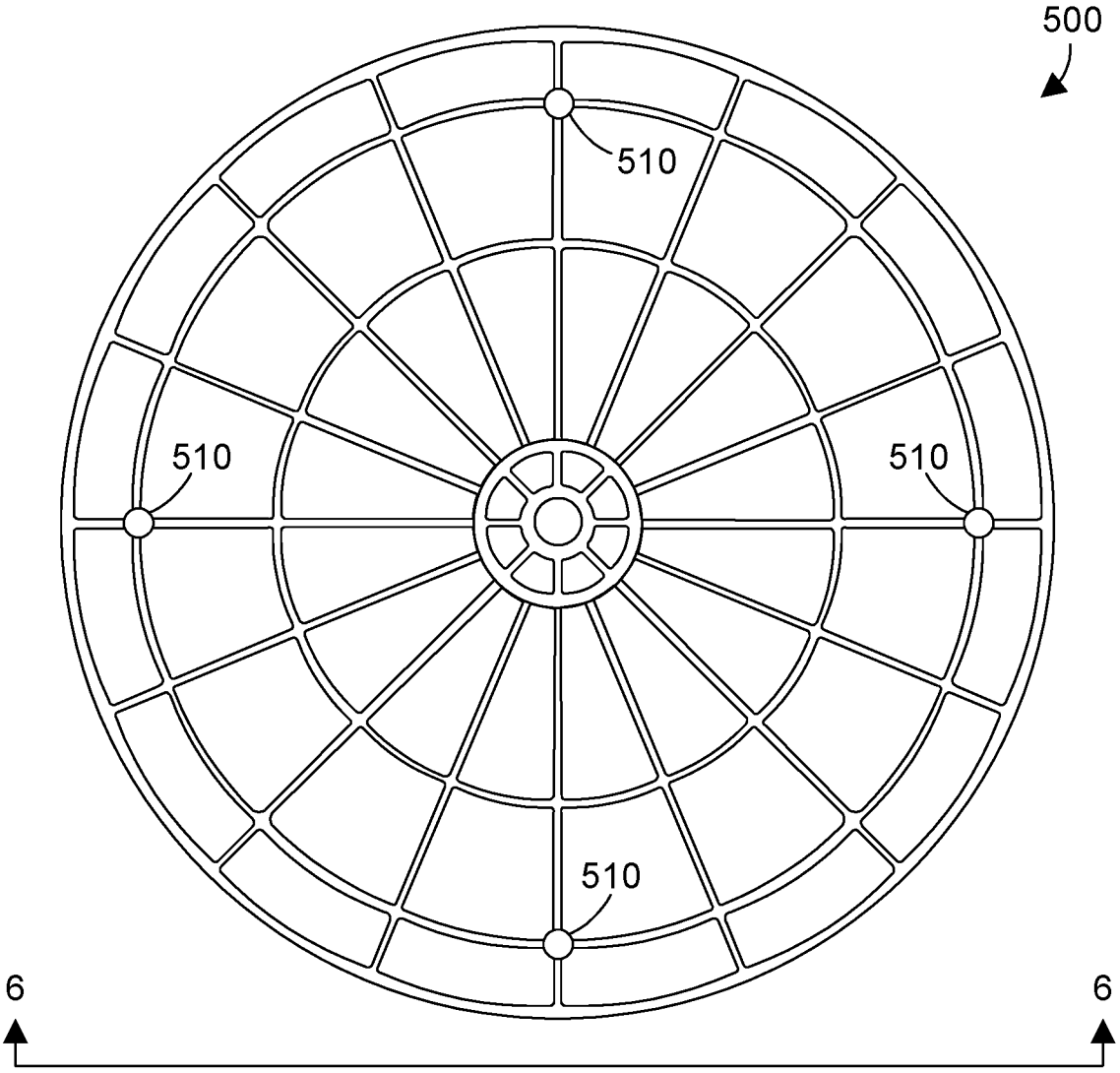
FIG. 5 is a top view of one suitable configuration for a wobble base.

FIG. 5 shows a top view of one suitable configuration for a wobble base 500. The wobble base 500 is preferably made of injection-molded plastic to provide a wobble base 500 that is lightweight, yet strong enough to support a person without cracking, breaking, or otherwise failing. Of course, other suitable materials could also be used. The wobble base 500 includes a network of reinforcing members, for example as shown in FIG. 5, to provide the needed strength. The wobble stool 500 also includes one or more attachment points 510 for coupling the wobble base 500 to a seating platform. The specific wobble base 500 in FIG. 5 is configured to fit on the stool 100 shown in FIGS. 1 and 2, and therefore includes four attachment points 510 that are configured and spaced to mate with the receptacles 210 on the stool 100.

The wobble base 500 preferably includes a curved floor-contacting surface. The purpose of the curved floor-contacting surface is to allow a person seated on the stool to rock the stool to the front, back, or sideways while seated in a manner that makes the vertical axis of the stool shift from being normal to the plane of the floor to being slightly off-angle from normal. The disclosure and claims herein extend to any suitable curved floor-contacting surface. For example, the wobble base 500 could be curved front-to-back without being curved side-to-side, allowing a person to rock frontwards or backwards on the wobble stool, but preventing the person from rocking side to side. In the most preferred configurations, the curved floor-contacting surface allows the person seated to rock in all directions.

Figure 6:
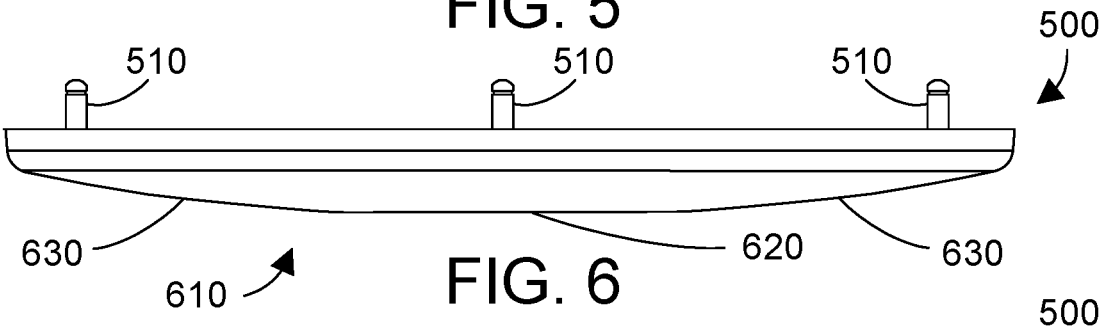
FIG. 6 is a front view of the wobble base in FIG. 5 taken along the line 6-6 according to a first embodiment.

FIG. 6 shows a front view of a first embodiment for the wobble base 500. In the first embodiment shown in FIG. 6, the attachment points 510 each have a post with an annular ring that is very similar in configuration as the post and annular ring on the leg 106 shown in FIG. 1 and caster 400 shown in FIG. 4. In an alternative embodiment the attachment points 510 are posts without the annular ring. When the attachment points 510 are posts without the annular ring, the posts are pressed in place into the receptacles, and the wobble base can then be secured to the base using one or more screws or nails. In the alternative, the posts could have a friction-fit with the receptacles, causing the wobble base to be retained within the posts without the need of other fasteners. The post for each attachment point 510 faces substantially up. This allows the wobble base 500 to be removably coupled to the stool 100 by pushing the four attachment points 510 into the four receptacles 210. Note that FIG. 6 only shows three attachment points 510 because the middle attachment point in the front aligns with the middle attachment point in the back. In the first configuration for the wobble base 600 shown in FIG. 6, the bottom of the wobble base 500 includes a substantially flat portion 620, with a substantially curved portion 630 on both sides of the substantially flat portion 620. The curved portions 630 and substantially flat portion 620 make up the floor-contacting surface 610 of the wobble base. By providing the substantially flat portion 620, the stool can be in an upright position when not in use.

Figure 7:
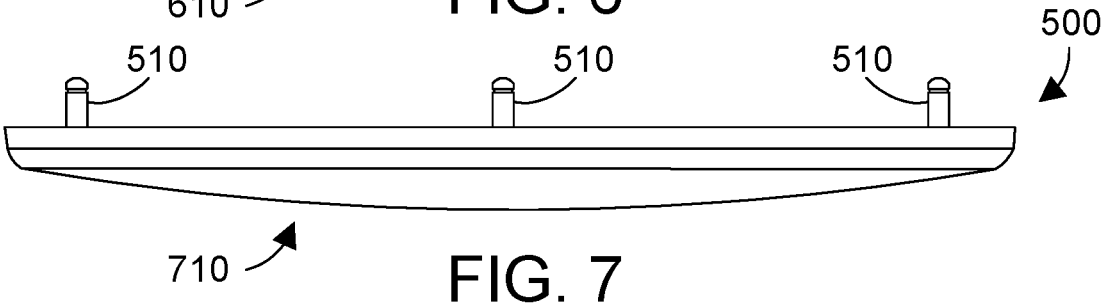
FIG. 7 is a front view of the wobble base in FIG. 5 taken along the line 6-6 according to a second embodiment.

FIG. 7 shows a front view of a second embodiment for the wobble base 500. The configuration in FIG. 7 shows the attachment points 510 each have a similar configuration as shown in FIG. 6, which allows the wobble base 500 to be removably coupled to the stool 100 by mating the four attachment points 510 to the four receptacles 210. In the second configuration for the wobble base 500 shown in FIG. 7, the bottom of the wobble base 500 includes a substantially dome-shaped portion 710 that provides a continuously-curved surface. The substantially dome-shaped portion 710 is the floor-contacting surface of the wobble base. Note the substantially dome-shaped portion 710 is not a hemisphere, but represents a bottom portion of a sphere, as if a slice were taken from the bottom of a sphere. The term "dome-shaped portion" as used herein means any suitable portion of a sphere of any suitable radius. Of course, the dome-shaped portion 710 need not be a perfect slice of a sphere, but could be offset such that the bottom center point of the dome-shaped portion 710 does not align with the center axis of the seating platform.

Figure 8:
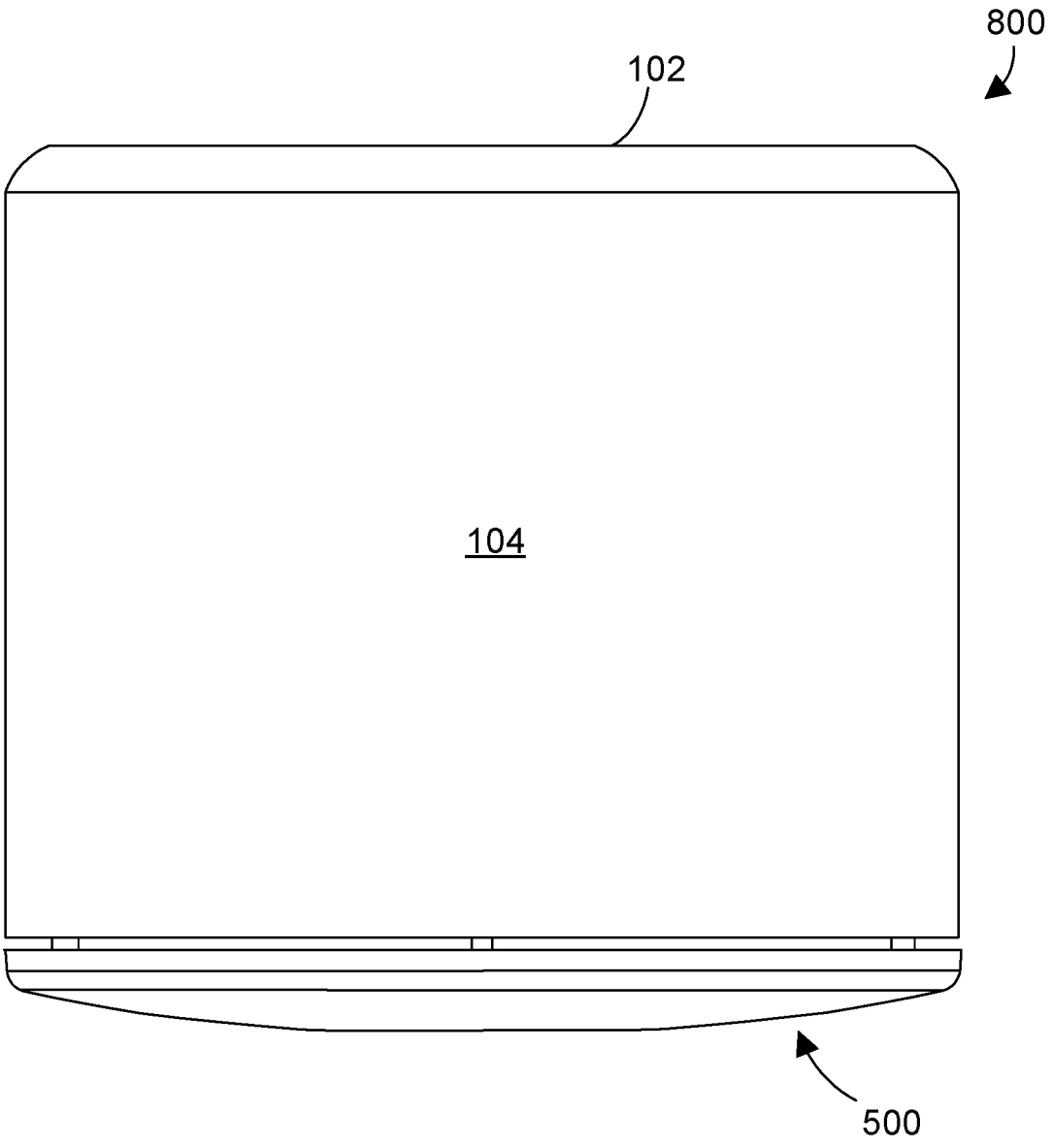
FIG. 8 is a front view of the stool in FIGS. 1 and 2 fitted with the wobble base in FIGS. 5 and 6 to provide a wobble stool.

Referring to FIG. 8, a stool 800 includes a top 102 and body portion 104 similar to those shown on stool 100 in FIG. 1, but additionally includes a wobble base 500 that is removably coupled to one or more receptacles on the bottom of the body portion 104. The wobble base 500 preferably includes one or more posts facing up, for example as shown in FIGS. 6 and 7, that mate with one or more corresponding receptacles facing down on the seating platform, for example as shown in FIG. 2. The wobble base 500 is installed onto the seating platform by pushing the posts on the wobble base 500 into the receptacles 210 on the seating platform. At this point, the stool with the wobble base is as shown in FIG. 800. Note the wobble base 500 is removable, which means the wobble base 500 could be removed and replaced with feet, such as 106 shown in FIG. 3, or with casters, such as 400 shown in FIG. 4. The result is a stool that is very versatile and can be easily changed to a desired configuration, as needed.

In the specific example shown in FIGS. 1-8, a stool has four receptacles for floor contacting members. A wobble base with four corresponding attachment points is removably coupled to the stool, thus converting the stool from a standard stool to a wobble stool. Note, however, the number and type of attachment points can vary within the scope of the disclosure and claims herein. For example, the stool could have more or less than four receptacles. In addition, the wobble base need not attach to all of the receptacles. Thus, if a stool has six receptacles for six feet that are evenly spaced at sixty-degree angles from each other with reference to a central point, a wobble base could be attached that has three attachment points at 120-degree angles, thereby engaging every other receptacle. In addition, the wobble base could attach to receptacles in the seating platform that are not used for floor-contacting members such as legs or casters. For example, let's assume that in addition to the four receptacles 210 shown in FIG. 2, the bottom 208 additionally includes a relatively large hole at the center of the circular bottom 208. With this configuration, legs such as 106 in FIG. 3 or casters such as 400 in FIG. 4 could be installed into the receptacles 210, or could be removed from the receptacles, with the wobble base having a single central attachment point that engages and removably attaches to the relatively large central hole. The disclosure and claims herein expressly extend to any suitable number and type of receptacles for attaching a wobble base to a seating platform.

There are many different types of legs and casters that can be removably attached to known types of receptacles in seating platforms in the prior art. For example, many office chairs include a base that includes four to six arms that each have a caster, with the main chair support extending upwards from the center of the base. This makes such an office chair very mobile and easy for a person to roll about the office, even when seated. Note, however, the disclosure and claims herein are not limited to receptacles or floor-contacting members that are known in the art. For example, in one specific configuration, the leg or caster could have a post that friction-fits with the receptacle. With this configuration, the wobble base will have corresponding attachment points that friction-fit with one or more receptacles on the seating platform. The disclosure and claims herein expressly extend to using any suitable receptacle, whether currently known or developed in the future, for removably coupling a wobble base or any suitable type of floor-contacting members to a seating platform. The disclosure and claims further extend to any suitable attachment point(s) on a wobble base for coupling the wobble base to one or more corresponding receptacles a seating platform.

Figure 9:
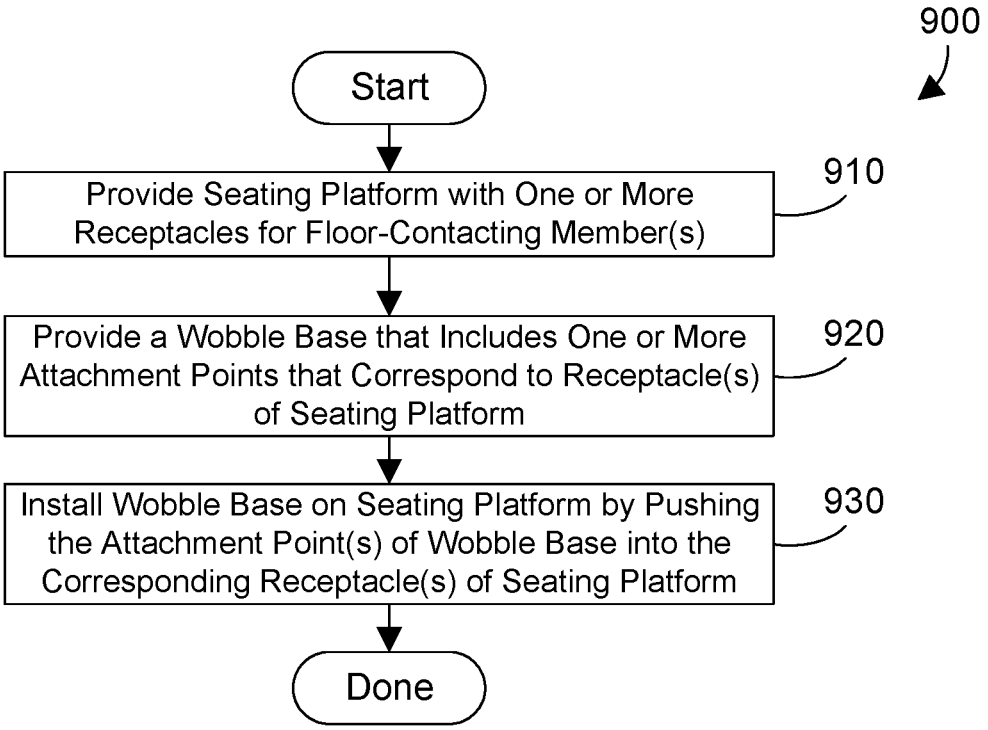
FIG. 9 is a flow diagram of a method for providing a seating platform with a removable wobble base.

Referring to FIG. 9, a method 900 shows how a wobble base can be removably coupled to a seating platform. A seating platform with one or more receptacles for floor-contacting members is provided (step 910). A wobble base that includes one or more attachment points that correspond to the receptacle(s) of the seating platform is also provided (step 920). The wobble base is then installed on the seating platform by pushing the attachment point(s) of the wobble base into the corresponding receptacle(s) of the seating platform (step 930). When the attachment points are retained within the receptacles, such as when the attachment points are posts that have a snap ring in an annular slot or that friction-fit into the receptacles, no further attachment is needed. When the attachment points are posts without a snap ring and that do not friction-fit into the receptacles, the wobble base can be secured to the seating platform after step 930 using suitable screws, nails or other fasteners. Method 900 is then done. The seating platform with the wobble base is now ready for use.

Figure 10:
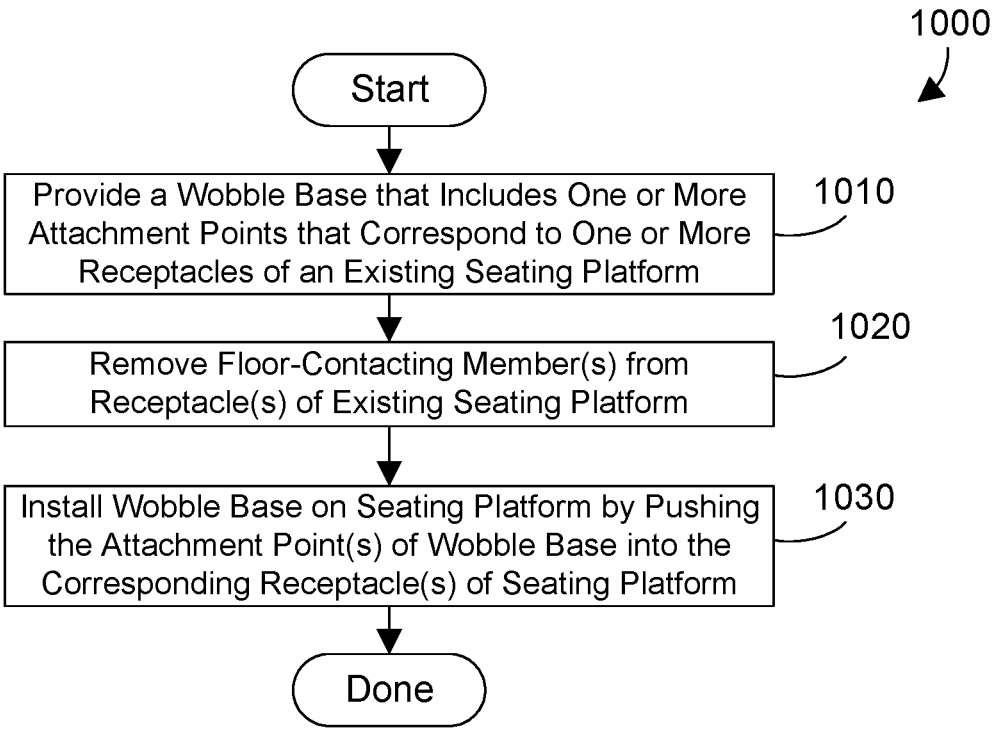
FIG. 10 is a flow diagram of a method for retrofitting an existing seating platform that has traditional floor-contacting members with a removable wobble base.

One of the benefits of having a wobble base with attachment points similar to known legs and casters is an existing seating platform can be easily retrofitted to have a wobble base, as shown in method 1000 in FIG. 10. A wobble base that includes one or more attachment points that correspond to one or more receptacle(s) of an existing seating platform is provided (step 1010). If the receptacles on the existing seating platform have floor-contacting members installed, these floor-contacting members are removed (step 1020). The wobble base is then installed on the seating platform by pushing the attachment point(s) of the wobble base into the corresponding receptacle(s) of the seating platform (step 1030). If needed, the wobble base can also be secured using one or more screws, nails or other fasteners. Method 1000 is then done. The existing seating platform with legs or casters has thus been reconfigured to have a wobble base.

Providing a wobble base that matches the configuration of existing stools or other seats allows those stools and other seats to be converted to have a wobble base without having the expense of replacing the existing stools or other seats. The wobble base thus provides a relatively low-cost method for converting existing seating platforms to wobble seating platforms.

Figure 11:
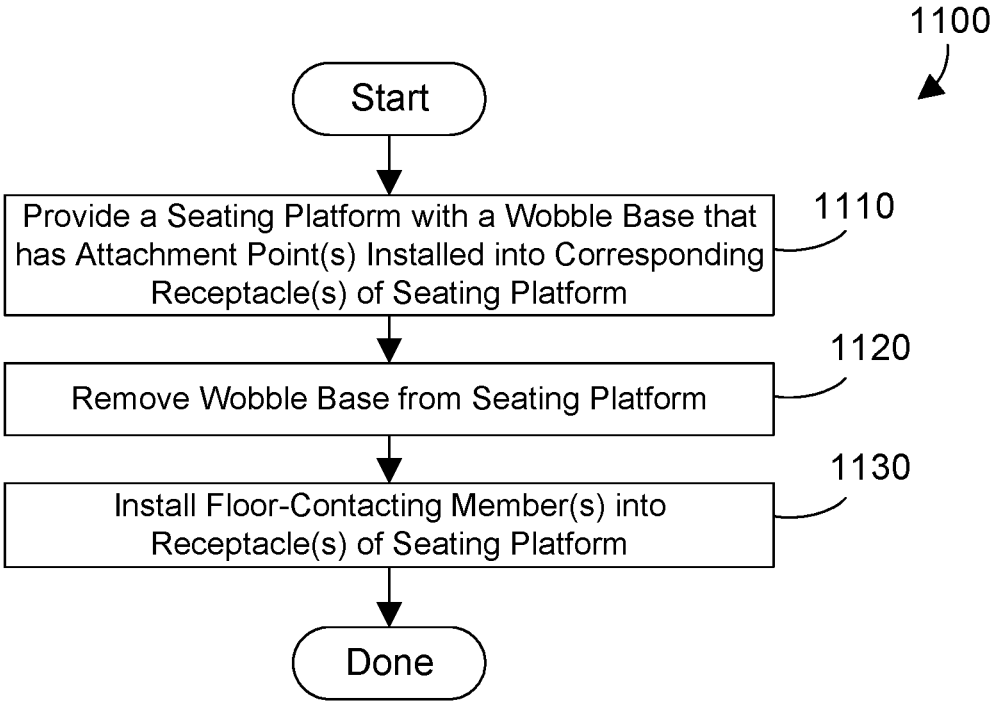
FIG. 11 is a flow diagram of a method for replacing a wobble base on a seating platform with floor-contacting members.

Having a wobble base that is removably coupled to a seating platform allows the wobble base to be removed if the seating platform needs to be reconfigured to have traditional floor-contacting members. Referring to FIG. 11, method 1100 shows the steps to convert a seating platform that has a removable wobble base to have floor-contacting members instead. A seating platform with a wobble base that has one or more attachment points installed into corresponding receptacles of a seating platform is provided (step 1110). The wobble base is removed from the seating platform (step 1120). The floor-contacting members are installed into the receptacle(s) of the seating platform (step 1130). Method 1100 is then done. By providing a wobble base removably coupled to a seating platform, the wobble base can be removed so the seating platform can be dynamically reconfigured as needed.

Because a stool as disclosed herein, such as stool 800 in FIG. 8, has receptacles that can receive either a wobble base or a floor-contacting member, such as a leg or caster, a stool can now be sold that is very versatile. Thus, a stool similar to stool 800 in FIG. 8 could be sold with four feet such as 106 shown in FIG. 3, with four casters such as caster 400 shown in FIG. 4, and with a wobble base 500 as shown in FIGS. 6 and 8. Because the stool is sold with three different options for floor-contacting members, the stool can be reconfigured, as needed. Thus, if a stool is used in the morning in a classroom for a student that needs a wobble base, the wobble base can be installed on the stool for that student. If the same stool is used in the afternoon for a student that needs a roller base, the wobble base can be removed and casters can be installed into the receptacles, thereby providing a rolling stool. If the same stool is used in the evening for a student that needs a stationary base, the four casters can be removed and four legs can be installed into the receptacles, thereby providing a stationary stool. The four legs can then be removed and replaced with the wobble base for the next morning's class. Because the wobble base is removably coupled to the stool, it can be removed and reinstalled as needed, providing very flexible seating options.

Figure 12:
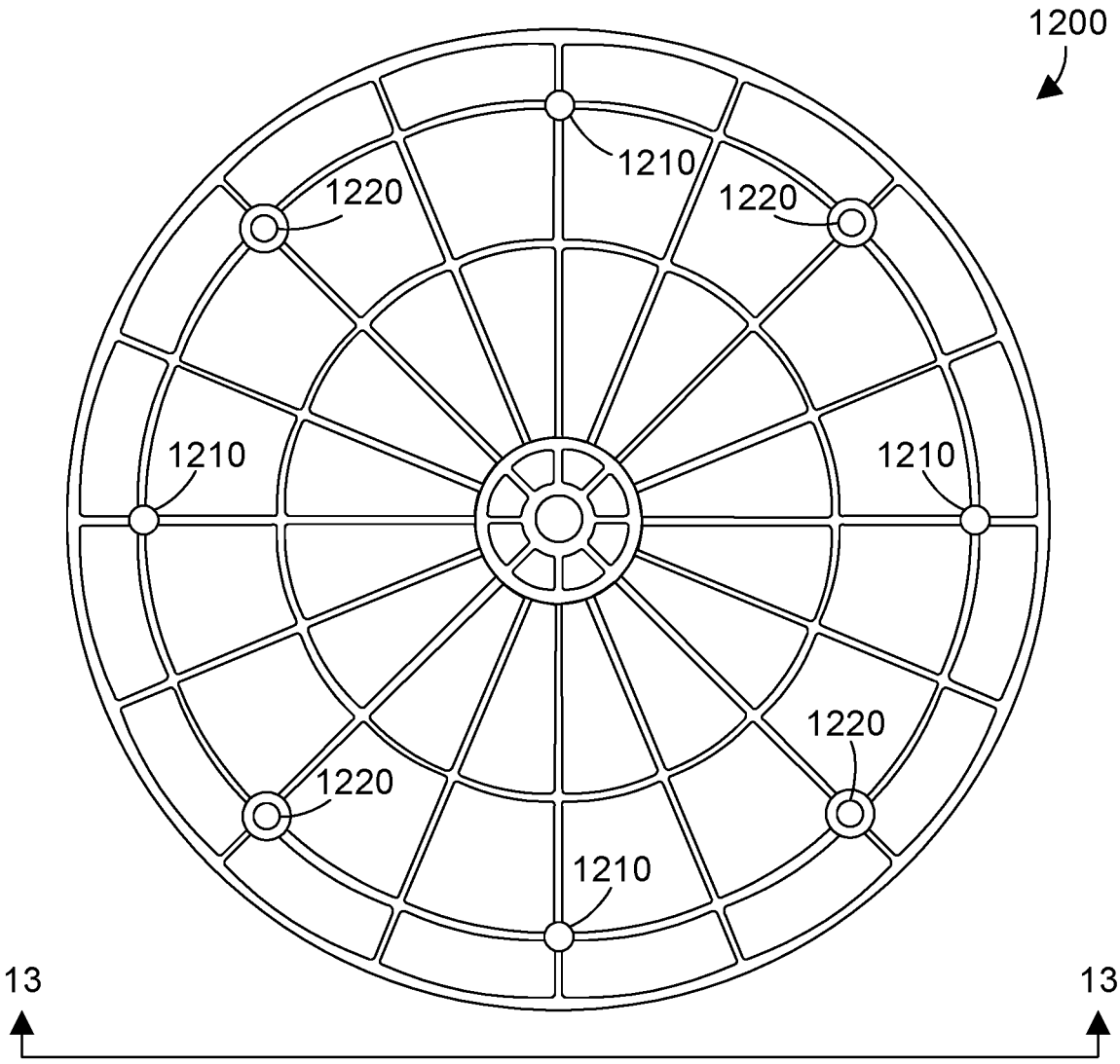
FIG. 12 is a top view of one suitable configuration for a wobble base.
Figure 13:
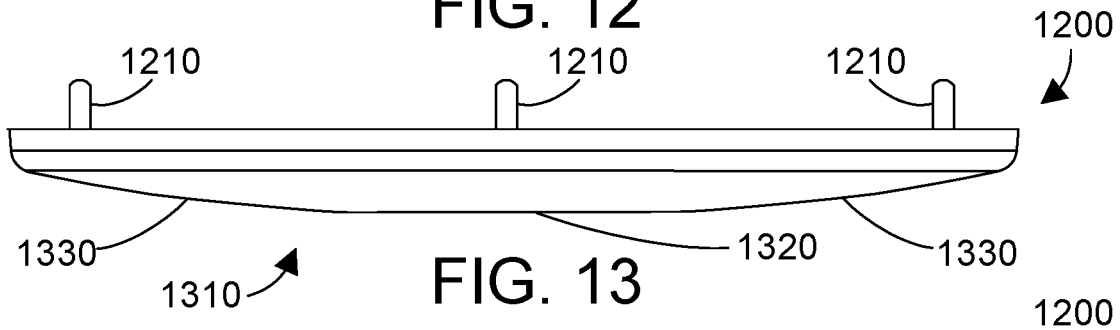
FIG. 13 is a front view of the wobble base in FIG. 12 taken along the line 13-13 according to a third embodiment.
Figure 14:
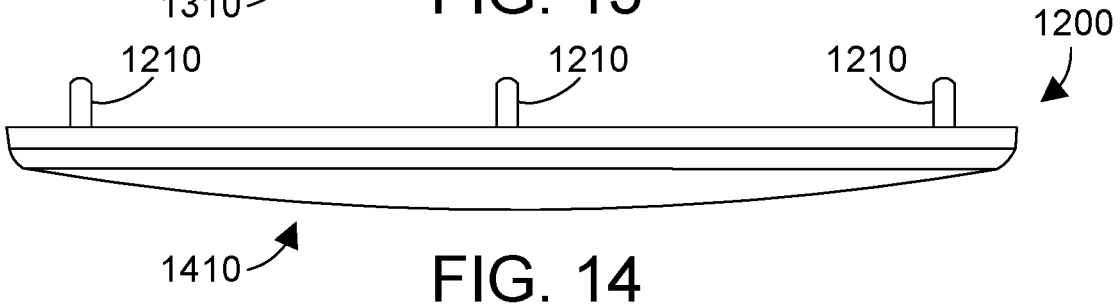
FIG. 14 is a front view of the wobble base in FIG. 12 taken along the line 13-13 according to a fourth embodiment.

Referring to FIGS. 12-14, an alternative configuration for the wobble base is shown according to a different embodiment. While the wobble base shown in FIGS. 5-7 includes attachment points 510 in the form of posts with slots that engage the corresponding receptacles to hold the wobble base in place, the configuration shown in FIGS. 12-14 show alignment posts 1210 that align with and are pushed into corresponding receptacles on a seating platform, but the alignment posts 1210 do not engage the receptacles to attach the wobble base 1200 to the seating platform. Instead, separate holes 1220 are provided so that once the alignment posts 1210 are pushed into the receptacles on a seating platform, a suitable fastener can be placed through holes 1220 to attach the wobble base 1200 to a seating platform. The configuration shown in FIG. 12 shows four alignment posts 1210 and four holes 1220 that are separate from the alignment posts 1210. For this specific configuration, the four alignment posts 1210 are pushed into the corresponding receptacles on a seating platform, and four screws are then screwed through the four holes 1220 into the lower portion of the seating platform, thereby securing the wobble base to the lower portion of the seating platform.

The wobble base 1200 shown in FIG. 13 has a floor contacting surface 1310 that includes a curved portion 1330 and a substantially flat portion 1320. The floor contacting surface 1410 shown in FIG. 14, in contrast, is a dome-shaped portion.

Figure 15:
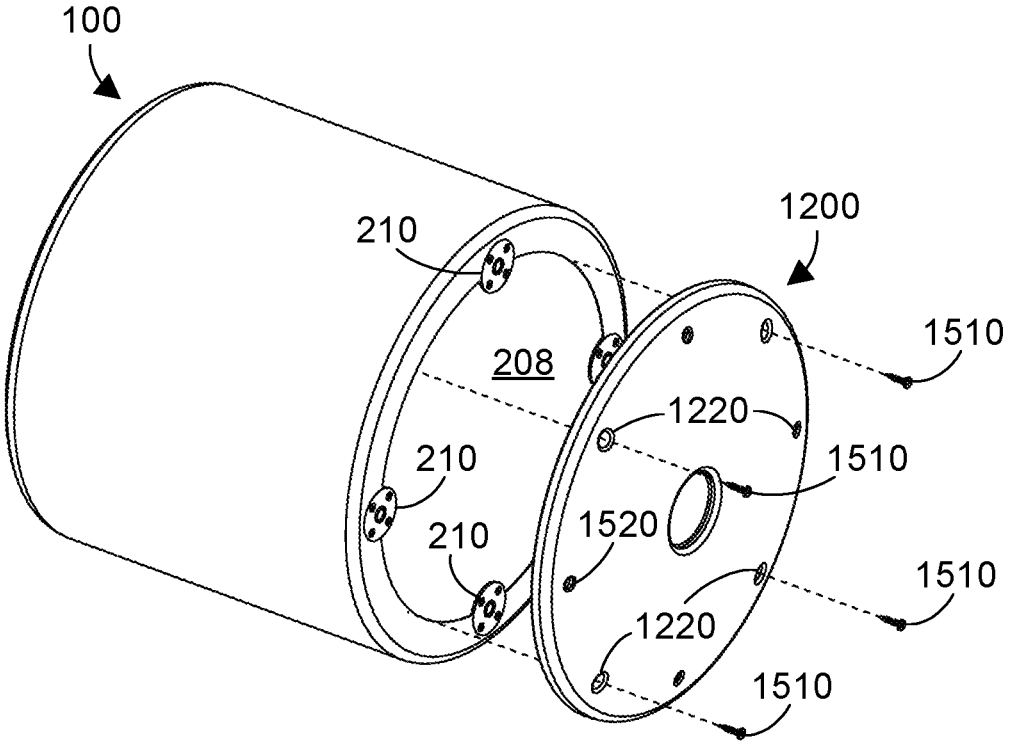
FIG. 15 is a perspective view showing installation of the wobble base onto a seating platform by aligning the alignment posts with the receptacles, pushing the alignment posts into the receptacles, and securing the wobble base to the seating platform using multiple fasteners such as screws.

FIG. 15 shows how a wobble base 1200 is installed onto the lower portion of a seating platform, such as stool 100 shown in FIGS. 1 and 2. The four alignment posts 1210 shown in FIGS. 12-14, which are not shown in FIG. 15, are aligned with the corresponding receptacles 210 on the seating platform and are then pushed into the corresponding receptacles 210. Note the alignment posts do not attach to or engage the receptacles, but provide a simple function of aligning the wobble base 1200 to the base of the stool 100. The bottom of the wobble base 1200 has recessed dimples (e.g., 1520 in FIG. 15) opposite the alignment posts that allow multiple wobble bases 1200 to be stacked for shipping. Four screws 1510 are then used to attach the wobble base to the lower portion of the seating platform by screwing the screws 1510 through the holes 1220 into the bottom 208 of the seating platform. Removing the wobble base can be done by reversing these steps. Thus, to remove the wobble base 1200 from the stool, the four screws 1510 in FIG. 15 are unscrewed from the base 208 and removed, and the wobble base 1200 is then pulled so the alignment posts 1210 slide out of the corresponding receptacles 210. Once the wobble base 1200 is removed, floor-contacting members can be installed into the receptacles 210.

Figure 16:
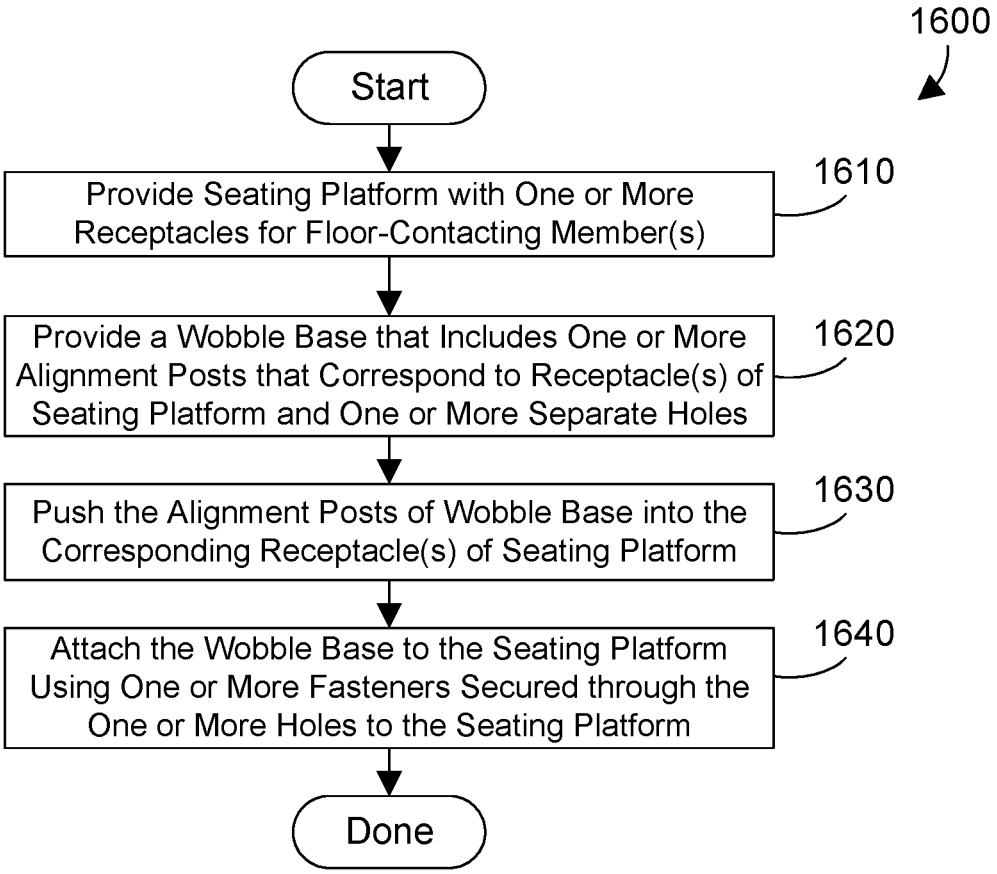
FIG. 16 is a flow diagram of a method for providing a seating platform with a removable wobble base.

A method 1600 for providing a seating platform with a removable wobble base 1200 as shown in FIGS. 12-15 is shown in FIG. 16. Provide a seating platform with one or more receptacles for floor-contacting member(s) (step 1610). Provide a wobble base that includes one or more alignment posts that correspond to the receptacle(s) of the seating platform, and one or more separate holes (step 1620). Push the alignment posts of the wobble base into the corresponding receptacle(s) of the seating platform (step 1630). Attach the wobble base to the seating platform using one or more fasteners securing through the one or more holes to the seating platform (step 1640). Method 1600 is then done.

Figure 17:
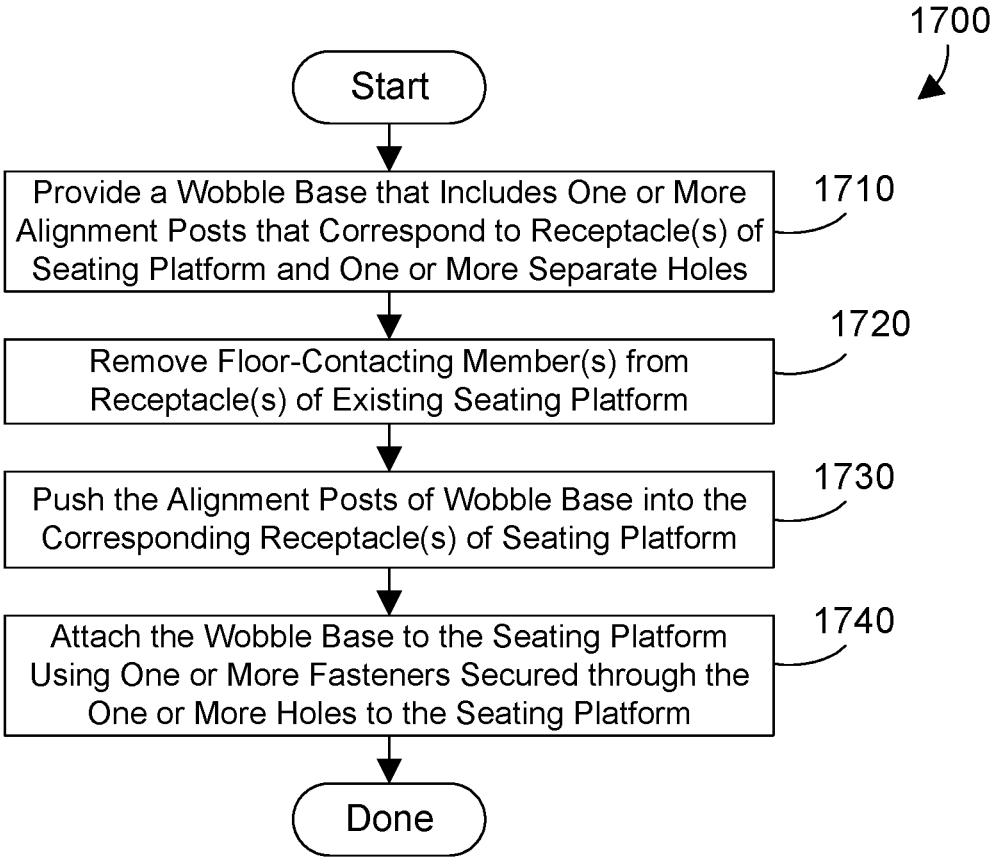
FIG. 17 is a flow diagram of a method for retrofitting an existing seating platform that has traditional floor-contacting members with a removable wobble base.

A method 1700 for retrofitting an existing seating platform that has traditional floor-contacting members with a removable wobble base 1200 as shown in FIGS. 12-15 is shown in FIG. 17. Provide a wobble base that includes one or more alignment posts that correspond to one or more receptacles of a seating platform and one or more separate holes (step 1710). Remove the floor-contacting member(s) from the receptacle(s) of the existing seating platform (step 1720). Push the alignment posts of the wobble base into the corresponding receptacles of the seating platform (step 1730). Attach the wobble base to the seating platform using one or more fasteners secured through the one or more holes to the seating platform (step 1740). Method 1700 is then done.

Figure 18:
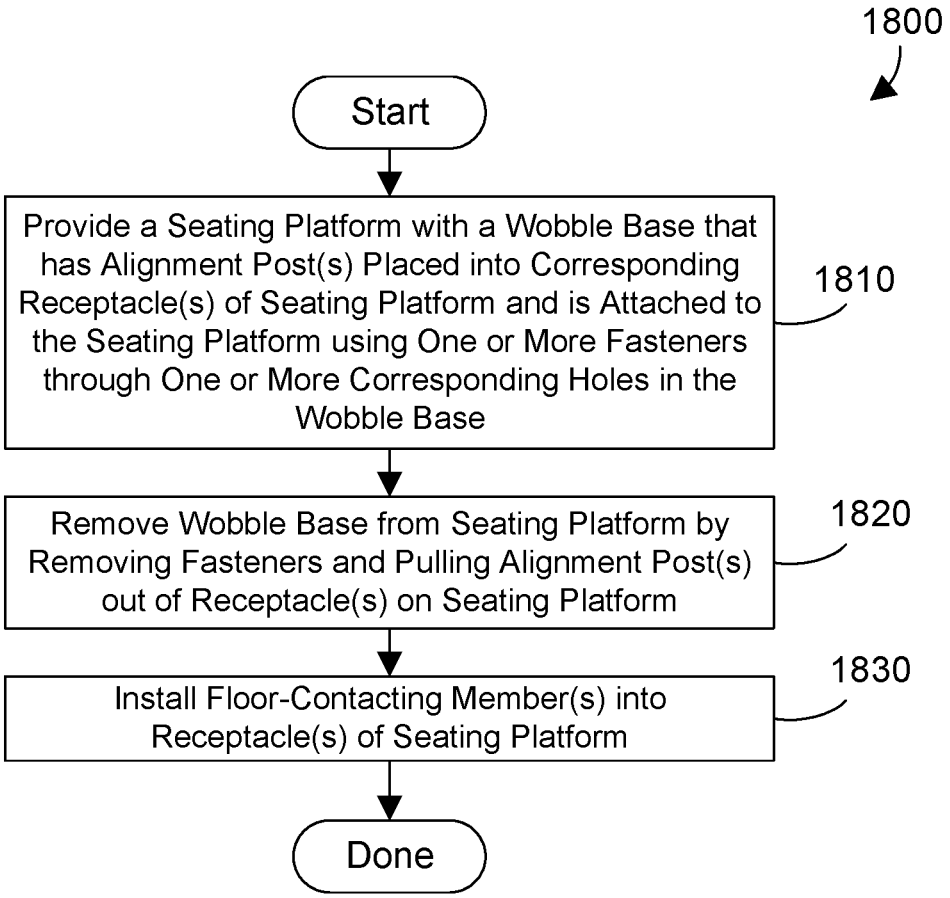
FIG. 18 is a flow diagram of a method for replacing a wobble base on a seating platform with floor-contacting members.

A method 1800 for replacing a wobble base as shown in FIGS. 12-15 on a seating platform with floor-contacting members is shown in FIG. 18. Provide a seating platform with a wobble base that has one or more alignment posts placed into corresponding receptacle(s) of the seating platform and is attached to the seating platform using one or more fasteners through one or more corresponding holes in the wobble base (step 1810). Remove the wobble base from the seating platform by removing the fasteners and pulling the alignment post(s) out of the receptacle(s) on the seating platform (step 1820). Install floor-contacting member(s) into the receptacle(s) of the seating platform (step 1830). Method 1800 is then done.

While the specific configuration shown in the figures and discussed herein includes receptacles on the seating platform and posts on the floor-contacting members, the disclosure and claims herein could additionally extend to a configuration that has posts on the stool and receptacles on the floor-contacting members, including the leg, the caster, and the wobble base.

A wobble base provides a curved floor-contacting surface with one or more alignment posts and one or more fastener holes that allow removably coupling the wobble base to a lower portion of a seating platform, such as a stool, thereby providing a wobble stool. The wobble base can be configured to convert an existing stool into a wobble stool by replacing one or more floor-contacting members with the wobble base. In a second embodiment, a stool is provided with both traditional floor-contacting members, such as feet or casters, and with a wobble base that allows the traditional floor-contacting members to be removed and replaced with the wobble base, and allows the wobble base to be removed and replaced with the traditional floor-contacting members.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. A wobble base for a seating platform comprising:

a curved floor-contacting surface;

a plurality of alignment posts that align the wobble base to a bottom of the seating platform without attaching to the bottom of the seating platform; and a plurality of holes separate from the alignment posts that allow the wobble base to be removably coupled to a lower portion of the seating platform by installing at least one fastener through each of the plurality of holes to secure the wobble base to the seating platform.

2. The wobble base of claim 1 wherein the curved floor-contacting surface comprises a substantially flat portion coupled to at least one curved portion.

3. The wobble base of claim 1 wherein the curved floor-contacting surface comprises a substantially dome-shaped portion.

4. The wobble base of claim 1 wherein each of the plurality of alignment posts comprises a post pointing substantially up that is pushed into a corresponding receptacle pointing substantially down on a lower portion of the seating platform.

5. The wobble base of claim 4 wherein each receptacle pointing down on the lower portion of the seating platform is configured to receive a corresponding floor-contacting member such that the wobble base may be replaced by at least one floor-contacting member.

6. A wobble base comprising:

a curved floor-contacting surface;

four alignment posts pointing substantially up that are pushed into four corresponding receptacles pointing substantially down on a lower portion of a seating platform to align the wobble base to the seating platform without attaching the wobble base to the bottom of the seating platform; and a plurality of holes separate from the four alignment posts that allow the wobble based to be removably coupled to a lower portion of a seating platform by installing at least one fastener through each of the plurality of holes to secure the wobble base to the seating platform.

7. The wobble base of claim 6 wherein the curved floor-contacting surface comprises a substantially flat portion coupled to at least one curved portion.

8. The wobble base of claim 6 wherein the curved floor-contacting surface comprises a substantially dome-shaped portion.

9. The wobble base of claim 6 wherein each of the four corresponding receptacles pointing substantially down on the lower portion of the seating platform is configured to receive a corresponding floor-contacting member such that the wobble base may be replaced by four floor-contacting members.

10. A seating apparatus comprising:

a seating platform having a lower portion that comprises at least one receptacle; and a wobble base comprising:

a curved floor-contacting surface;

a plurality of alignment posts that align the wobble base to a bottom of the seating platform without attaching to the bottom of the seating platform; and a plurality of holes separate from the alignment posts that allow the wobble based to be removably coupled to a lower portion of the seating platform by installing at least one fastener through each of the plurality of holes to secure the wobble base to the seating platform.

11. The seating apparatus of claim 10 wherein the curved floor-contacting surface comprises a substantially flat portion coupled to at least one curved portion.

12. The seating apparatus of claim 10 wherein the curved floor-contacting surface comprises a substantially dome-shaped portion.

13. The seating apparatus of claim 10 wherein the lower portion of the seating platform comprises four receptacles and the plurality of alignment posts on the wobble base are aligned to push into the four receptacles.

14. The seating apparatus of claim 10 wherein each attachment point comprises a post pointing substantially up that is pushed into a corresponding receptacle pointing substantially down on the lower portion of the seating platform.

15. The seating apparatus of claim 14 wherein each receptacle pointing substantially down on the lower portion of the seating platform is configured to receive a corresponding floor-contacting member such that the wobble base may be replaced by a plurality of the floor-contacting members.

16. A method for providing a seating apparatus with a removable wobble base comprising:

providing a seating platform having a lower portion that comprises a plurality of receptacles that each includes one of a plurality of floor-contacting members;

providing a wobble base comprising:

a curved floor-contacting surface;

a plurality of alignment posts that align the wobble base to a bottom of the seating platform without attaching to the bottom of the seating platform; and a plurality of holes separate from the alignment posts that allow the wobble based to be removably coupled to a lower portion of the seating platform by installing at least one fastener through each of the plurality of holes to secure the wobble base to the seating platform;

removing the plurality of floor contacting members from the plurality of receptacles on the lower portion of the seating platform;

pushing the plurality of alignment posts on the wobble base into the plurality of receptacles on the seating platform; and attaching the wobble base to the seating platform by installing at least one fastener through each of the plurality of holes in the wobble base to secure the wobble base to the seating platform.

17. The method of claim 16 wherein the curved floor-contacting surface comprises a substantially flat portion coupled to at least one curved portion.

18. The method of claim 16 wherein the curved floor-contacting surface comprises a substantially dome-shaped portion.

19. The method of claim 16 wherein the lower portion of the seating platform comprises four receptacles and the plurality of alignment posts on the wobble base comprises four alignment posts corresponding to the four receptacles.

20. The method of claim 16 wherein each alignment post on the wobble base comprises a post pointing substantially up that is pushed into a corresponding receptacle pointing substantially down on the lower portion of the seating platform to align the wobble base to the lower portion of the seating platform.

21. The method of claim 20 wherein each receptacle pointing down on the lower portion of the seating platform is configured to receive a corresponding floor-contacting member such that the wobble base may be replaced by a plurality of the floor-contacting members.

* * * * *